US005133679A

United States Patent [19]

Fusselman et al.

[11] Patent Number: 5,133,679

[45] Date of Patent: * Jul. 28, 1992

[54] CONNECTORS WITH GROUND STRUCTURE

[75] Inventors: David F. Fusselman, Middletown; Joseph A. Oswald, Jr., Mechanicsburg; Peter K. Townsend, Camp Hill, all of Pa.

[73] Assignee: E. I. Du Pont de Nemours and Company, Wilmington, Del.

[ * ] Notice: The portion of the term of this patent subsequent to Oct. 8, 2008 has been disclaimed.

[21] Appl. No.: 719,954

[22] Filed: Jun. 24, 1991

Related U.S. Application Data

[63] Continuation-in-part of Ser. No. 535,432, Jun. 8, 1990, Pat. No. 5,055,069.

[51] Int. Cl.[5] ..... H01R 13/648

[52] U.S. Cl. ..... 439/608; 439/79

[58] Field of Search ..... 439/81, 80, 607-610, 439/92, 108

[56] References Cited

U.S. PATENT DOCUMENTS

| | | | |
|---|---|---|---|
| 4,568,134 | 2/1986 | DeMondi | 339/17 |
| 4,601,527 | 7/1986 | Lemke | 339/14 |
| 4,655,518 | 4/1987 | Johnson et al. | 339/17 |
| 4,686,607 | 8/1987 | Johnson | 361/413 |
| 4,806,107 | 2/1989 | Arnold et al. | 439/79 |
| 4,806,109 | 2/1989 | Manabe et al. | 439/607 |
| 4,824,383 | 4/1989 | Lemke | 439/108 |
| 4,840,573 | 6/1989 | Seidel et al. | 439/92 |
| 4,846,727 | 7/1989 | Grover et al. | 439/608 |
| 4,867,690 | 9/1989 | Thumma | 439/79 |
| 4,869,677 | 9/1989 | Johnson et al. | 439/80 |
| 4,898,546 | 2/1990 | Elco et al. | 439/607 |
| 4,914,062 | 4/1990 | Voltz | 439/608 |

*Primary Examiner*—Larry I. Schwartz
*Assistant Examiner*—Hien D. Vu
*Attorney, Agent, or Firm*—John E. Griffiths

[57] ABSTRACT

This invention relates to electrical connectors with a ground structure for impedance and cross talk control between signal carrying conductors and, in particular, where the connector is a angled or right angle receptacle.

24 Claims, 7 Drawing Sheets

CONNECTORS WITH GROUND STRUCTURE

CROSS REFERENCE TO RELATED APPLICATIONS

This is a continuation-in-part application of copending U.S. Pat. application Ser. No. 07/535,432 filed Jun. 8, 1990, now U.S. Pat. No. 5,055,069.

BACKGROUND OF THE INVENTION

1. Field of the Invention

This invention relates to electrical connectors with a ground structure for cross talk control between signal carrying conductors and, in particular, where the connector is a right angle receptacle or a right angle header.

2. Description of Related Art

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. No. 4,655,518 (to Lennart B. Johnson et al.), U.S. Pat. No. 4686,607 (to Lennart B. Johnson) and U.S. Pat. No. 4,869,677 (to Lennart B. Johnson et al.) disclose a daughter board/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide a high density right angle electrical connector for electrically and mechanically interconnecting electronic circuits and/or components controlling cross talk within the connector.

Furthermore, it is an object of this invention to provide a high density angled or right angle electrical receptacle for electrically and mechanically interconnecting a circuit assembly and a plurality of terminals arranged in rows and columns in a header or shroud to control impedance and/or cross talk thereby to reduce or minimize degradation of signal transmission within the receptacle.

Furthermore, it is an object of this invention to provide a high density angled or right angle electrical header for electrically and mechanically interconnecting a circuit assembly and a plurality of terminals arranged in rows and columns in a receptacle to control impedance and/or cross talk thereby to reduce, prevent or minimize degradation of signal transmission within the header.

SUMMARY OF THE INVENTION

The present invention is directed to an angled or right angle electrical connector for electrically and mechanically interconnecting a circuit assembly and a second connector having a plurality of terminals, each terminal having a terminal contact, the terminal contacts arranged in rows and columns, the angled or right angle connector comprising:

an insulative housing;

a plurality of electrical contact elements in the housing wherein:

each one of the contact elements has a first connector contact and a second connector contact, the first connector contacts are arranged in rows and columns for contacting the terminal contacts, each one of the contact elements, except the contact elements with their first connector contacts in an nth row, includes a middle portion configured such that their second connector contacts extend at an angle with respect to the first connector contacts, a first set of the plurality of the contact elements with their first connector contacts in the nth row having a middle portion configured such that their second connector contacts extend at the angle with respect to the first connector contacts, and a second set of the plurality of the contact elements with their first connector contacts in the nth row; and a first conductive shield electrically connected to a subset of the second set, but none of the first set, of the contact elements.

The present invention is further directed to an angled or right angle electrical connector for electrically and mechanically interconnecting a circuit assembly and a second connector having a plurality of terminals, each terminal having a terminal contact, the terminal contacts arranged in rows and columns, the angled or right angle connector comprising:

an insulative housing;

a plurality of electrical contact elements in the housing wherein:

each one of the contact elements has a first connector contact and a second connector contact, the first connector contacts are arranged in rows and columns for contacting the terminal contacts, each one of the contact elements, except the contact elements with their first connector contacts in an nth row, includes a middle portion configured such that their second connector contacts extend at an angle with respect to the first connector contacts, a first set of the contact elements with their first connector contacts in the nth row having a middle portion configured such that their second connector contacts extend at the angle with respect to the first connector contacts, and a second set of the contact elements with their first connector contacts in the nth row; and a plurality of conductive shields, each of the shields including:

baffles positioned between and spaced from columns of the middle portions of a group of the contact elements, a first shield contact for contacting each of the second connector contacts of the second set, but not the second connector contacts of the first set, in the group of the contact elements, and a plurality of second shield contacts positioned such that the second connector contacts, excluding the second connector contacts of the second set of contact elements in the nth row, and the second shield contacts are arranged in rows and columns for connection to the circuit assembly.

The present invention is further directed to a conductive shield for reducing cross talk between contact elements in angled or right angle connectors having an insulative housing and a plurality of the contact elements mounted in the housing, each one of the contact elements having a first connector contact and a second connector contact, the first connector contacts arranged in rows and columns, the shield comprising:

a plurality of baffles, each of the baffles for positioning between adjacent columns of middle portions of the contact elements such that the baffles are spaced from the contact elements, a plurality of first shield contacts, one of the first shield contacts for contacting each of the second connector contacts of a subset of a first set, but none of a second set, of the contact elements in an nth row of the contact elements, and a plurality of second shield contacts positioned such that the second connector contacts of the contact elements, excluding the second connector contacts of the first set of the contact elements in the nth row, and the second shield contacts are for being arranged in rows and columns that are at an angle with respect to the rows and columns of the first connector contacts of the contact elements.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
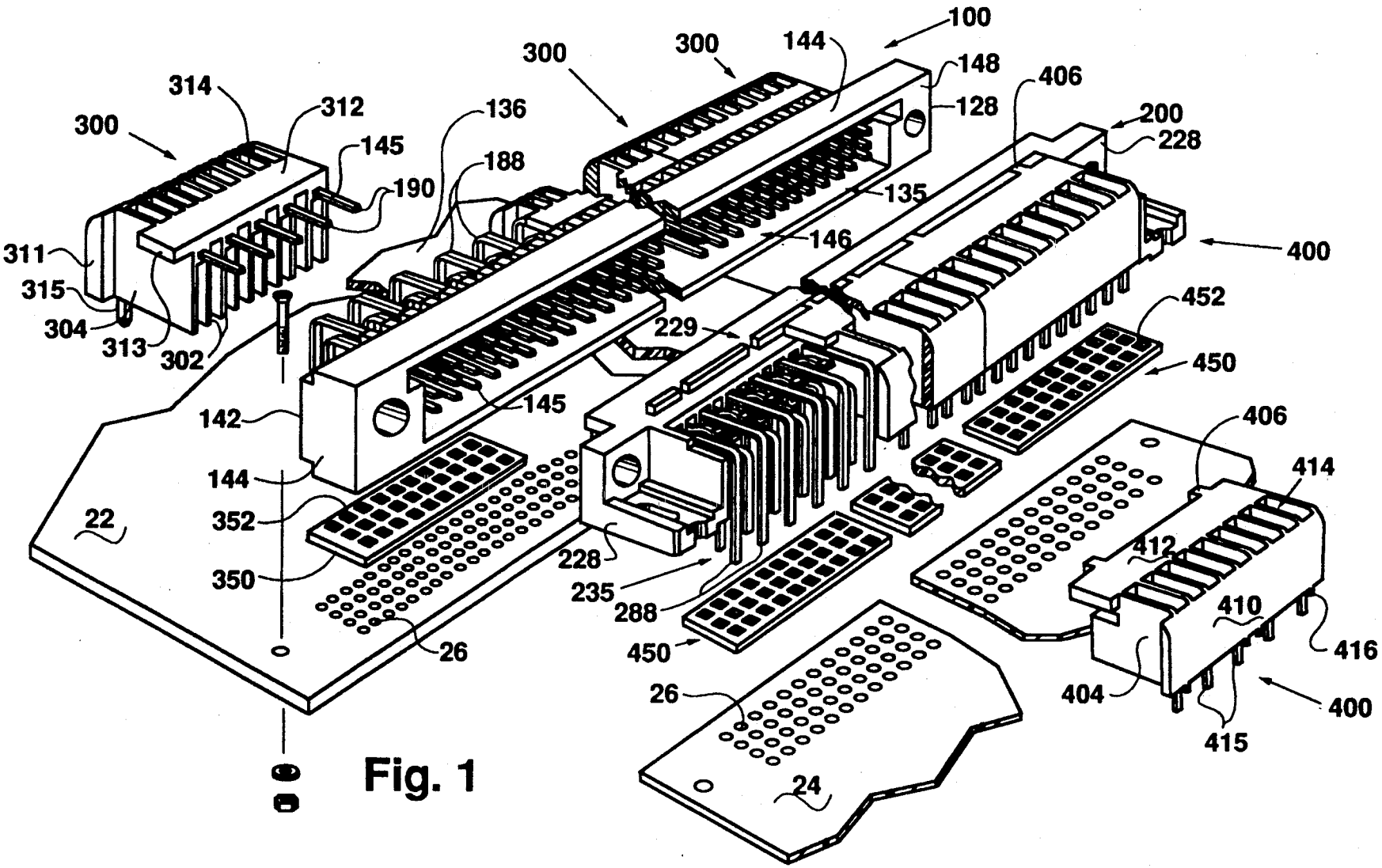
FIG. 1 is an exploded perspective view of a high density connector assembly in accordance with the present invention, the assembly including a high density angled or right angle receptacle and a high density angled or right angle header for interconnecting a first printed circuit or wiring board and a second printed circuit or wiring board.

Throughout the following detailed description, similar reference characters refer to similar elements in all figures of the drawings.

Referring to FIG. 1, there is illustrated a high density connector assembly in accordance with the present invention. The high density connector assembly includes a high density angled or right angle header 100 and a high density angled or right angle receptacle 200 for interconnecting a first circuit assembly printed circuit or wiring board 22 and a second circuit assembly printed circuit or wiring board 24.

Figure 3:
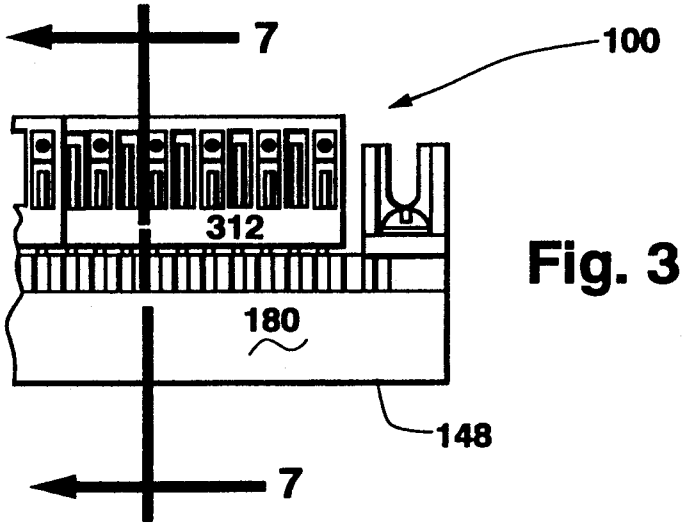
FIG. 3 is an enlarged view of a top side of the angled or right angle header of FIGS. 1 and 2.
Figure 2:
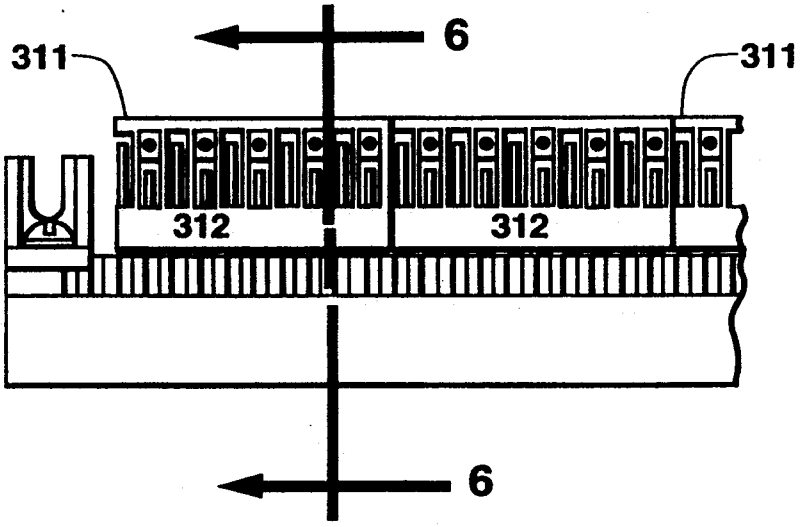
FIG. 2 is an enlarged view of a front or first mating side of the high density angled or right angle header of FIG. 1.
Figure 2:
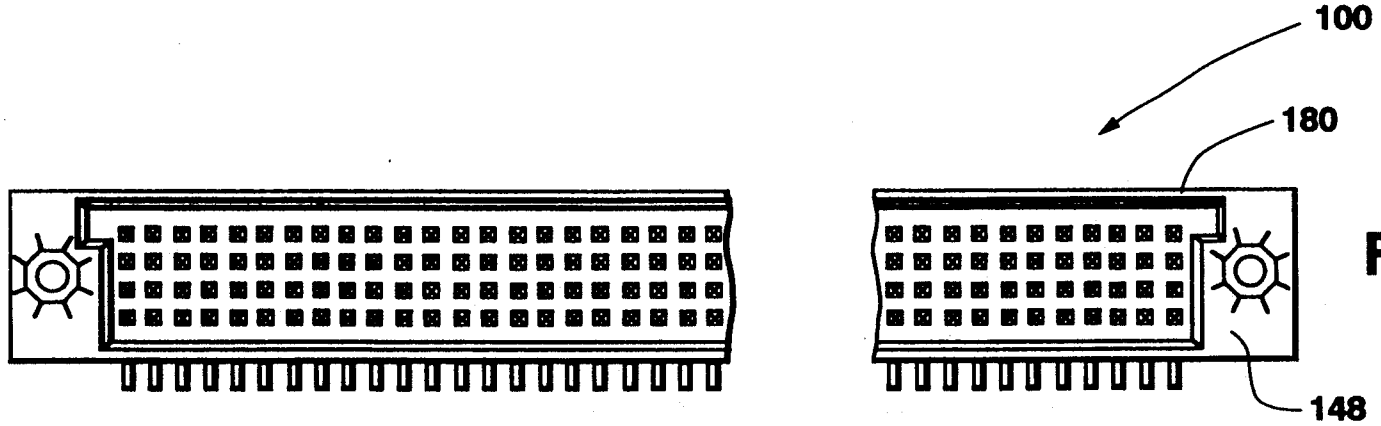

The angled or right angle header 100 comprises an insulative housing 128, a plurality of conductive electrical contact elements 135 mounted in the housing 128 and at least one conductive shield 300. FIG. 2 is an enlarged view of the first or front mating side 148 of the the high density angled or right angle header 100 of FIG. 1. FIG. 3 is an enlarged view of a top side 180 of the angled or right angle header 100 of FIGS. 1 and 2.

Figure 5:
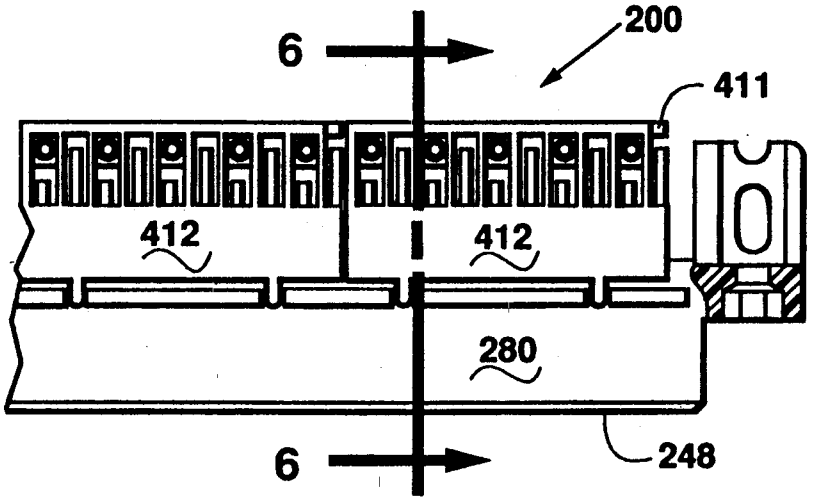
FIG. 5 is an enlarged view of a top side of the angled or right angle receptacle of FIGS. 1 and 4.
Figure 6:
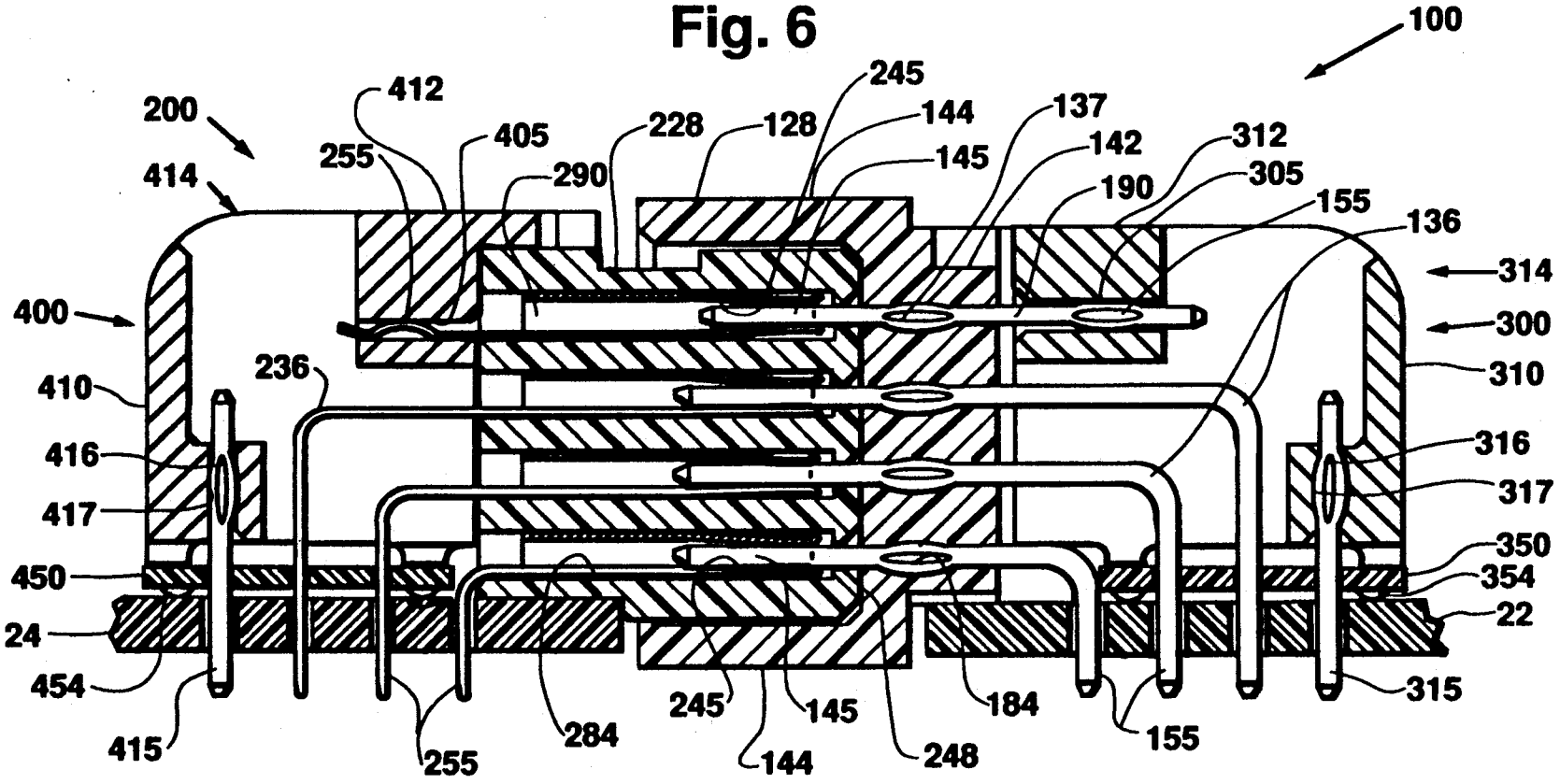
FIG. 6 is a first sectional view of the angled or right angle header of FIGS. 1-3 connected to the angled or right angle receptacle of FIGS. 1, 4 and 5.
Figure 7:
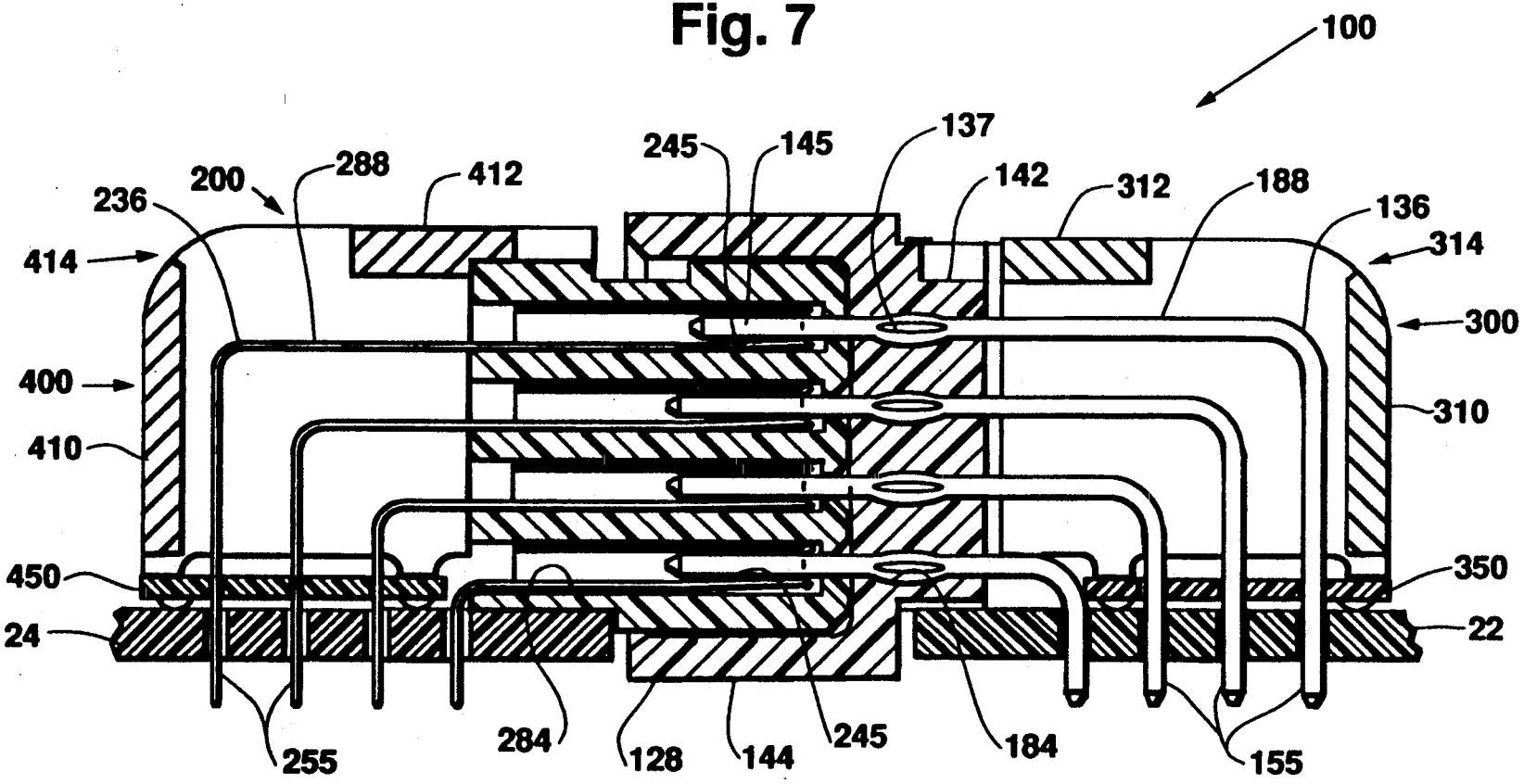
FIG. 7 is a second sectional view of the angled or right angle header of FIGS. 1-3 connected to the angled or right angle receptacle of FIGS. 1, 4 and 5.

Referring back to FIG. 1, the insulative housing 128 may have a base 142 and side walls 144 extending generally perpendicularly from the base 142. The base 142 and the side walls 144 partially enclose a contact region 146. As best seen in FIGS. 6 and 7, a plurality of passages 184 arranged in rows and columns extend through the base 142. FIG. 6 includes a cross sectional view of the header 100 connected to the receptacle 200 taken generally along the lines 6 in the direction of the arrows in FIGS. 3 and 5. FIG. 7 includes a cross sectional view of the header 100 connected to the receptacle 200 taken generally along the lines 7 in the direction of the arrows in FIGS. 3 and 5.

Referring to FIG. 1, the conductive electrical contact elements 135 may have any configuration so long as they are useable as angled or right angle contact elements. In other words, they may be male elements, female elements to gender neutral. More specifically, as best seen in FIGS. 6 and 7, each one of the electrical contact elements 135 has a first connector contact 145 and a second connector contact 155. Preferably, the first connector contacts 145 and the second connector contacts 155 are distal end portions of pins generally having a 0.025 inches by 0.025 inches square cross section. Each of the contact elements 135 can have a first compliant or press-fit section 137 which forms an interference fit in one of the passages 184 to secure the contact elements 135 in the housing 128. The first connector contacts 145 are positioned in the contact region 146 for contacting one of the contacts (such as contacts 245) of a mating receptacle (such as receptacle 200). Note, however, the first connector contacts 145 of the high density header 100 are not limited to only connecting to the contacts 245 of the high density receptacle 200. The first connector contacts 145 of the high density header 100 can be adapted to connect to any plurality of terminals or contact elements with a plurality of first contacts arranged in rows and columns in a receptacle. The receptacle that is mateable with the header 100 can be a vertical receptacle or an angled or right angle receptacle. Preferably, the contacts of the receptacle that is/are mateable with the header 100 are sockets or spring beams. If the receptacle that is mated with the header 100 is a right angle receptacle, then preferably it is the right angle receptacle 200 illustrated in FIG. 1.

The first connector contacts 145 are generally parallel to one another and arranged in rows and columns. There can be any number of rows and any number of columns of the first contacts 145. However, there are preferably at least two rows and at least two columns. Typically, there are three, four, five or six rows of the first connector contacts 145. The Figures depict four rows of the first connector contacts 145. Typically, there are many (e.g., up to 150) columns of the contact elements 135.

Each one of the contact elements 135, except the contact elements 135 with their first connector contacts 145 in an nth row of the passages 184, has a middle portion 136 configured such that their second connector contacts 155 extend at an angle or perpendicularly with respect to their first connector contacts 145. Preferably, these middle portions 136 have a right angle bend, two 45 degree angle bends or any shape that results in the second connector contacts 155 extending perpendicularly to the first connector contacts 145. In the embodiment illustrated in FIGS. 1-3, the nth row is the fourth row which is an end row. Referring to FIG. 1, a first set 188 of the contact elements 135 with their first connector contacts 145 in the nth row of the passages 184 have a middle portion 136 configured such that their second connector contacts 155 extend at an angle or perpendicularly to the first connector contacts 145. Preferably, the first set 188 of the contact elements 135 in the fourth row are the longest contact elements 135 in the connector 100. Like the middle portions 136 of the contact elements 135 in the rows other than the nth row, the middle portions 136 of the first set 188 of the contact elements 135 in the nth row preferably have a right angle bend, two 45 degree angle bends or any shape that results in the second connector contacts 155 extending perpendicularly to the first connector contacts 145. There is also a second set 190 of at least one of the contact elements 135 with its/their first connector contacts 145 in the nth row of the passages 184. Preferably, the first set 88 comprises a plurality of the contact elements 135 in the nth row. Preferably, the second set 190 comprises a plurality of the contact elements 135 in the nth row. More preferably, the second connector contacts 155 of the second set 190 of the contact elements 135 are generally collinear or parallel to the first connector contacts 145. Also more preferably, one of the second set 190 is between every pair of the first set 188. The second connector contacts 155, except those of the second set 190, can be through mount contacts or surface mount contacts. FIG. 6 is a cross section showing one of the contact elements 135 in the second set 190. FIG. 7 is a cross section showing one of the contact elements 135 in the first set 188.

Each one of the conductive shields 300 is electrically connectable to a different subset of the second set 190, but none of the first set 188, of the contact elements 135. One or more or the shields 300 can be selectively placed over selected columns of the contact elements 135. While other columns of the contact elements 135 need not have a shield 300 associated with them depending on their intended use. The conductive shields 300 can be connected to the housing 128 by any means. For instance, each one of the second set 190 of the contact elements 135 can have a second compliant or press-fit section as its second contact 155 for forming an interference fit in a passage 305 in the shield 300 holding the shield 300 to the housing 128.

Figure 8:
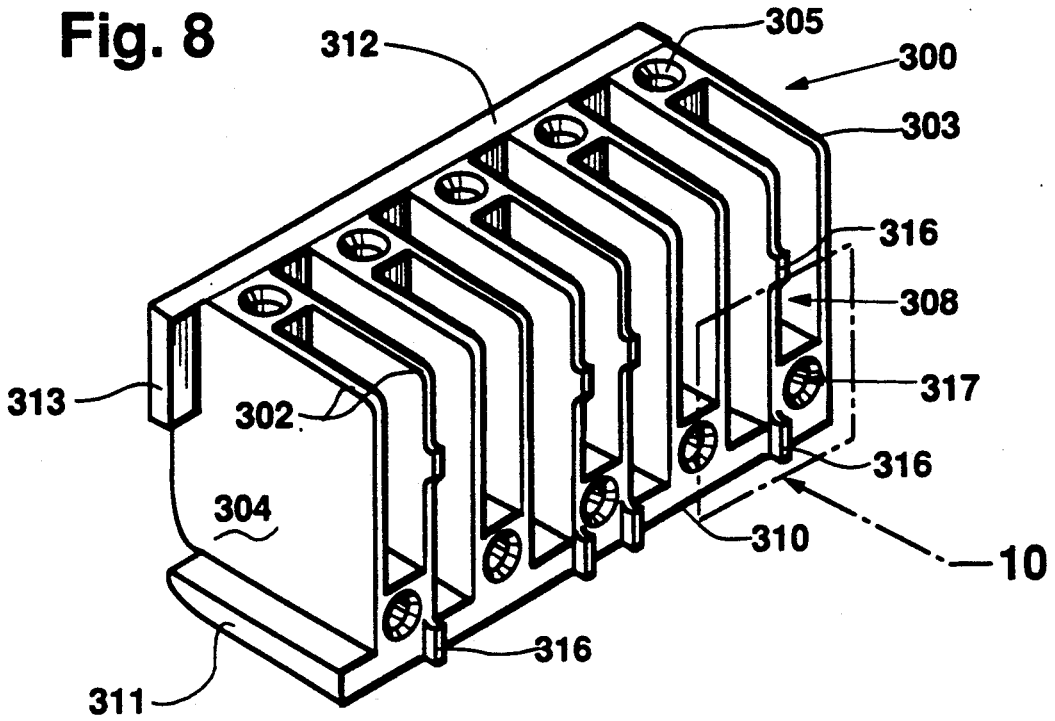
FIG. 8 is an isometric view of a header shield in accordance with the present invention.

FIG. 8 is an isometric view of portions of one of the header shields 300 in accordance with the present invention. Each of the shields 300 includes a plurality of baffles 302. One of the baffles 302 is preferably for being positioned between and spaced from adjacent columns of the middle portions 136 of a group of the contact elements 135. The number in each group of the contact elements 135 may vary or be the same. As illustrated in the Figures, each group of the contact elements 135 may comprise, for instance, 10 columns of the contact elements 135. Preferably, one of the baffles 302 is for being placed between each pair of adjacent columns of the middle portions 136 of the contact elements 135 in the group, but this is not necessary. Preferably, the baffles 302 include a first end baffle 303 which is for being positioned next to the last column of the middle portions 136 of the contact elements 135 in the group. The first end baffle 303 may be positioned between the last column of the middle portions 136 of the contact elements 135 in the group and a first column of the middle portions 136 of the contact elements 135 in a second adjacent group of the contact elements 135. The second group of the contact elements 135 may or may not have a corresponding shield 300 associated with it. The baffles 302 further include a second end baffle 304 which has a function similar to that of the first end baffle 303. The shields 300 including the baffles 302 can be made of any conductive non-magnetic material. Alternatively, the shields 300 and/or the baffles 302 can be polymeric and have a conductive layer or coating.

Referring to FIGS. 6 and 8, each shield 300 includes a first shield contact 305 for contacting each of the second connector contacts 155 of the second set 190 of the contact elements 135. Preferably, the first shield contacts 305 are slots, holes or passages in the shield 300 for receiving the second contacts or compliant sections 155 of the second set 190 of the contact elements 135. The shield 300 further includes a plurality of second shield contacts 315 positioned such that the second shield contacts 315 and the second connector contacts 155, excluding the second connector contacts 155 of the second set 190 of the contact elements 135 in the nth row, are arranged in rows and columns for connection to the circuit assembly 22. One of the second shield contacts 315 is shown in FIG. 6. It is within the scope of this invention for the second shield contacts 315 to be arranged in one or more rows and in such row(s) with or without the second connector contacts 155 (excluding the second connector contacts 155 of the second set 190 of the contact elements 135 in the nth row) positioned in the row(s) with the second shield contacts 315. Preferably, the second shield contacts 315 are end portions of pins. The second shield contacts 315 can have the same shape as, or a different shape than, the second connector contacts 155. For instance, both the second connector contacts 155 and the second shield contacts 315 can be pin shaped, but the cross section of one of them, such as the second shield contacts 315 can be larger than the cross section of the other. The second shield contacts 315 can be cast out of the same metal as the rest of the shield 300. Alternatively, the second shield contacts 315 can be end portions of conductive pins with a compliant or press-fit section 316 secured in holes or passages 317 in the shield 300.

The shield 300 illustrated in the figures provides 1 ground path for every 7 signal paths. In other words, ground contacts 305 are provided to mate with one contact 155 in every other column of the contact elements 135. Since 4 contact elements 135 are depicted in each column of the contact elements 135, this provides 1 ground for each 7 signal paths. Alternatively, the shield can be configured to provide 1 ground path for every 11 signal paths. In this case, ground contacts 305 are provided to mate with one contact 155 in every third column of the contact elements 135. Alternatively, ground contacts 305 can be provided to mate with one contact 155 in every column of the contact elements 135 or with one or more contacts in any set or subset of the columns of the contact elements.

Preferably, each shield 300 further comprises a first elongated outer side wall 310 connected to each of the baffles 302. The compliant or press-fit sections 316 of the pins with the second shield contacts 315 are received in passages 317 in the first side wall 310. Each shield 300 further comprises a second elongated outer side wall 312 connected to each of the baffles 302. The second compliant or press-fit sections 155 (i.e., the second connector contacts 155 of the second set 190 of the contact elements 135 in the nth row) are received in the passages 305 in the second side wall 312. An outer surface of the second side wall 312 is generally perpendicular to an outer surface of the first side wall 310. A tab portion 311 of the first side wall 310 and/or a tab portion 313 of the second side wall 312 can extend past the end baffle 304 distal to end baffle 303 of the shield 300. The tab portions 311,313 are adapted to extend over a column of the contact elements 135 between a first end baffle 303 of a first one of the shields 300 and a second end baffle 304 of a second one of the shields 300. This is best seen in FIG. 3. The tab portions 311,313 provide improved electrical and mechanical protection to the column of the contact elements 135 between the first end baffle 303 of a first one of the shields 300 and the second end baffle 304 of a second one of the shields 300. A minimum spacing is preferably provided between adjacent shields 300 to allow for manufacturing tolerance accumulation and differential termal expansion between the metallic shields 300 and the plastic housings 128.

Figure 10:
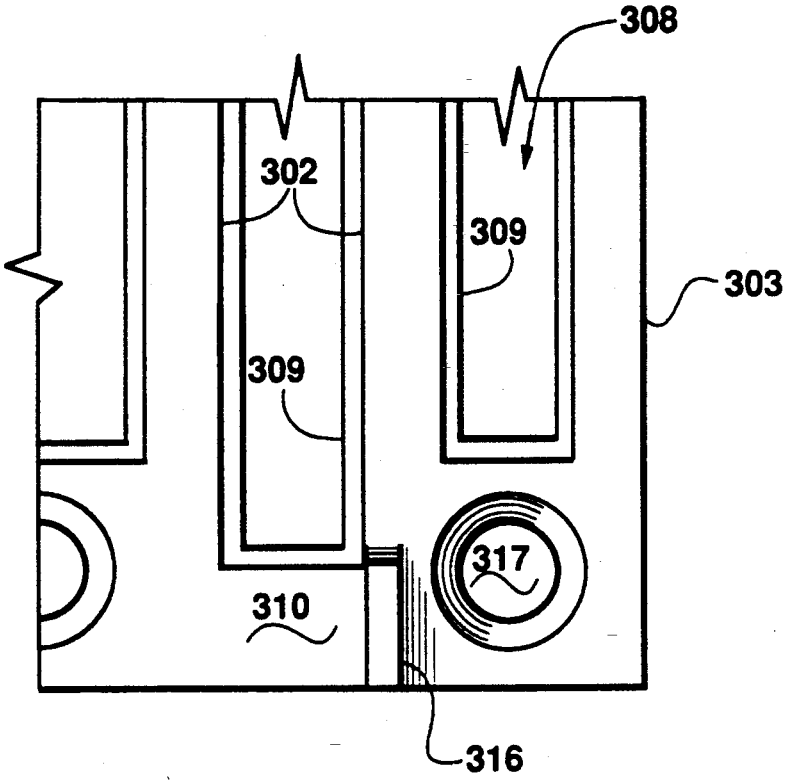
FIG. 10 is an enlarged view showing baffles lined with an insulator, adjacent pairs of the baffles defining shield pockets.

The first elongated outer side wall 310, the second elongated outer side wall 312 and adjacent pairs of the baffles 302 define pockets 308 for receiving the middle portions 136 of one column of the contact elements 135. To ensure that the middle portions 136 do not short out by contacting a conductive portion of the shield 300, the pockets 308 can be coated with an insulative layer 309. FIG. 10 is a view of a portion of the shield 300 illustrating the insulative layers 309. The portion of the shield shown in FIG. 10 is an enlarged view of the portion of the shield 300 enclosed by phantom line segments in FIG. 8.

Cleaning slots or passages 314 may exist through the shield 300 between the first side wall 310 and the second side wall 312 extending into each of the pockets 308. Further, the shields 300 may have stand-offs 316 along edges of the walls 310,312 and the baffles 302 to allow cleaning fluids to flow between the shield 300 and adjacent parts.

The angled or right angle header 100 may further include an insulative spacer 350 associated with each one of the shields 300. However, the contact elements 135 may be rigid enough (and/or the handling and insertion to board may be gentle enough) not to use insulative spacers 350. Each one of the spacers 350 has a plurality of holes 352 through it arranged in rows and columns. The second connector contacts 155, except the second connector contacts 155 in the second set 190, extend through holes 352 of the spacers 350. Further, the second shield contacts 315 extend through holes 352 of the spacers 350. Preferably, as best seen in FIGS. 6 and 7, the first row of the contact elements 135 do not pass through holes 352 in the spacers 350 because the first row of the contact elements 135 is the shortest, the strongest and the most difficult row to be inserted through holes of a spacer. Restated, each of the groups of the contact elements 135, except a first row of the contact elements and the second set 190 of the nth row of the contact elements 135 in that group, extend through the holes 352 of a different one of the insulative spacers 350 such that the second shield contacts 315 and the second connector contacts 155, excluding the second contacts of the second set 190 of the contact elements 135 in the nth row, are on one side of the spacers 350 and the middle portions 136 are on another side of the spacers 350. The spacer 350 can have standoffs 354 to provide a space for cleaning purposes between the majority of the spacer 350 and the assembly 22. The spacer 350 can have sleeves (not depicted) extending from the holes 352 for insertion into the pockets 308 to reduce lateral movement of the spacer 350 and the second connector contacts 155 with respect to the shield 300. For attachment and location purposes, spacer 350 can be press fit on the second shield contacts 315 and/or the the second connector contacts 155, excluding the second contacts of the second set 190 of the contact elements 135 in the nth row.

The angled or right angle connector 200 is structurally and functionally similar to the above described angled or right angle header 100, except the connector 200 is a receptacle. Parts of the receptacle 200 that correspond to or with parts in the header 100 are designated by the same numbers used in referring to the header parts increased by 100.

Figure 4:
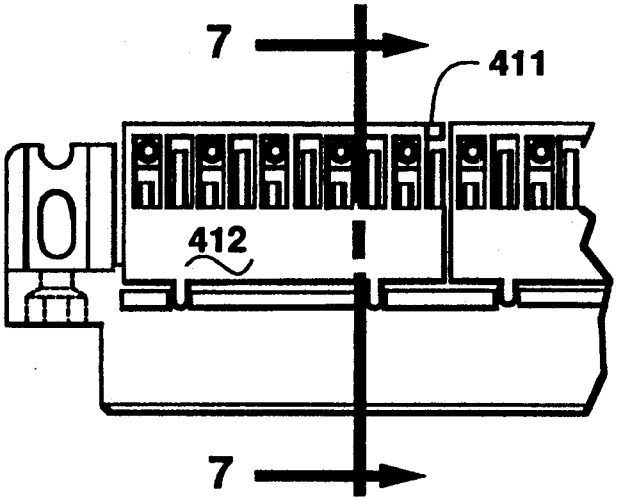
FIG. 4 is an enlarged view of a front or first mating side of the high density angled or right angle receptacle of FIG. 1.
Figure 4:
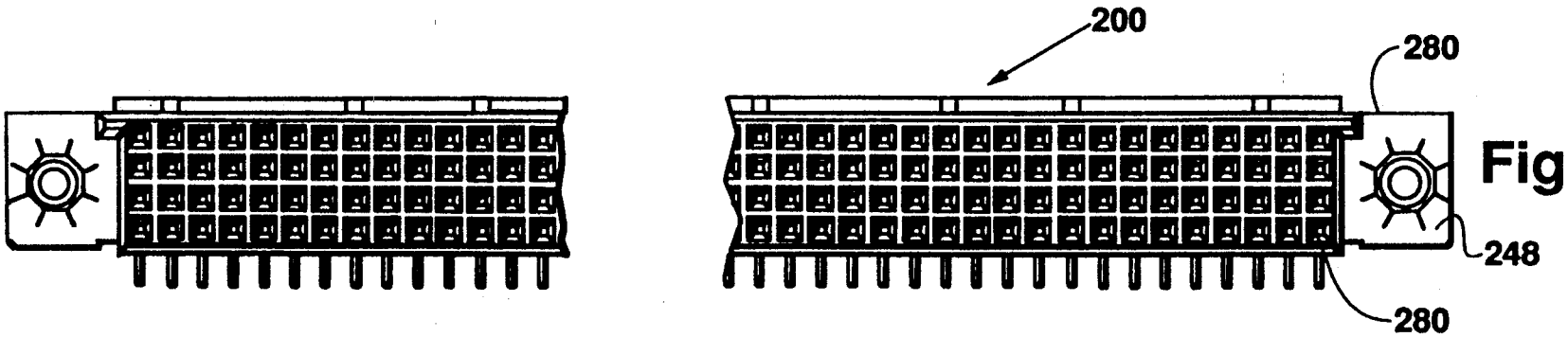

Referring to FIG. 1, the angled or right angle receptacle 200 comprises an insulative housing 228, a plurality of conductive electrical contact elements 235 mounted in the housing 228 and at least one conductive shield 400. FIG. 4 is an enlarged view of a front or first, header or shroud, mating side or surface 248 of the high density angled or right angle receptacle 200 of FIG. 1. FIG. 5 is an enlarged view of a top side 280 of the angled or right angle receptacle 200 of FIGS. 1 and 4.

As best seen in FIGS. 6 and 7, the housing 228 has a plurality of passages 284 arranged in rows and columns extending perpendicularly from the first mating side or surface 248 through the housing 228.

Referring to FIG. 1, the conductive electrical contact elements 235 may have any configuration so long as they are useable as angled or right angle contact elements. In other words, they may be male elements, female elements or gender neutral. More specifically, as best seen in FIGS. 6 and 7, each one of the conductive electrical contact elements 235 has a first connector contact 245 and a second connector contact 255. The first connector contacts 145 can be, for instance, socket shaped or spring beams. The second connector contacts 155 can be substantially flat solder tails. One of the first connector contacts 245 is secured in each one of the passages 284 for contacting one of the contacts (such as contacts 145) of a mating header (such as header 100). Note, however, the first connector contacts 245 of the high density receptacle 200 are not limited to only connecting to the contacts 145 of the high density header 100. The first connector contacts 245 of the high density receptacle 200 can be adapted to connect to any plurality of terminals or contact elements with a plurality of first contacts arranged in rows and columns in a header. The header that is mateable with the receptacle 200 can be a vertical header or an angled or right angle header. Preferably, the contacts of the header that is/are mateable with the receptacle 200 are end portions of pins. If the header that is mated with the receptacle 200 is a right angle header, then preferably it is the right angle header 100 illustrated in FIG. 1.

The first connector contacts 245 are generally parallel to one another and arranged in rows and columns in the passages 284. There can be any number of rows and any number of columns of the first connector contacts 245. However, there are preferably at least two rows and at least two columns. Typically, there are three, four, five or six rows of the first connector contacts 245. The Figures depict four rows of the first connector contacts 245. Typically, there are many columns (e.g., up to 150) of the first connector contacts 245.

Each one of the contact elements 235, except the contact elements 235 with their first connector contacts 245 in an nth row of the passages 284, has a middle portion 236 configured such that their second connector contacts 255 extend at an angle or perpendicularly with respect to the first connector contacts 245. Preferably, these middle portions 236 have a right angle bend, two 45 degree angle bends or any shape that results in the second connector contacts 255 extending perpendicularly to the first connector contacts 245. In the embodiment illustrated in FIGS. 1, 4 and 5, the nth row is the fourth row which is an end row. Referring to FIG. 1, a first set 288 of the contact elements 235 with their first connector contacts 245 in the nth row of the passages 284 have a middle portion 236 configured such that their second connector contacts 255 extend at an angle or perpendicularly to the first connector contacts 245. Preferably, the first set 288 of the contact elements 235 in the fourth row are the longest contact elements 235 in the connector 200. Like the middle portions 236 of the contact elements 235 in the rows other than the nth row, the middle portions 236 of the first set 288 of the contact elements 235 in the nth row preferably have a right angle bend, two 45 degree angle bends or any shape that results in the second connector contacts 255 extending perpendicularly to the first connector contacts 245. There is also a second set 290 of at least one of the contact elements 235 with its/their first connector contacts 245 in the nth row of the passages 284. Preferably, the first set 288 comprises a plurality of the contact elements 235 in the nth row. Preferably, the second set 290 comprises a plurality of the contact elements 235 in the nth row. More preferably, the second connector contacts 255 of the second set 290 of the contact elements 235 are generally collinear or parallel to the first connector contacts 245. Also more preferably, one of the second set 290 is between every pair of the first set 288. The second connector contacts 255, except those of the second set 290, can be through mount contacts or surface mount contacts. FIG. 6 is a cross section showing one of the contact elements 235 in the second set 290. FIG. 7 is a cross section showing one of the contact elements 235 in the first set 288.

Each one of the conductive shields 400 is electrically connectable to a different subset of the second set 290, but none of the first set 288, of the contact elements 235. The conductive shields 400 can be connected to the housing 228 by any means. For instance, each one of the second set 290 of the contact elements 235 can have an embossed section as its second contact 255 for forming an interference fit in a slot 405 in the shield 400 holding the shield 400 to the housing 228. The shield 400 may further have projections or teeth 406 that fit in corresponding slots 229 in or dividing a step on the housing 228. The projections 406 can be slightly larger than the slots forming a tight or interference fit between the projections 406 and the slots 229 further securing the shield 400 to the housing 228. The shield 400 may further have fingers (in addition to or in lieu of the projections that snap fit over a ridge (in addition to or in lieu of the segmented ridge defining the slots 229) on the housing 228.

Figure 9:
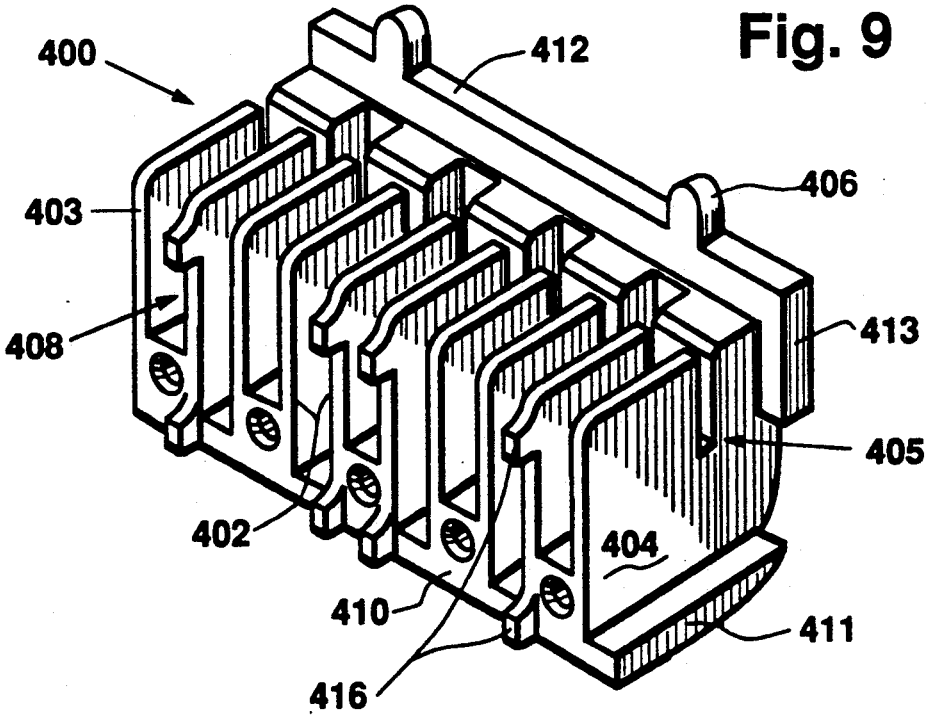
FIG. 9 is an isometric view of a receptacle shield in accordance with the present invention.

FIG. 9 is an isometric view of portions of one of the receptacle shields 400 in accordance with the present invention. Each of the shields 400 includes a plurality of baffles 402. One of the baffles 402 is preferably for being positioned between and spaced from adjacent columns of the middle portions 236 of a group of the contact elements 235. The number in each group of the contact elements 135 may vary or be the same. As illustrated in the Figures, each group of the contact elements 235 may comprise, for instance, 10 columns of the contact elements 235. Preferably, one of the baffles 402 is for being placed between each pair of adjacent columns of the middle portions 236 of the contact elements 235 in the group, but this is not necessary. Preferably, the baffles 402 include a first end baffle 403 which is for being positioned next to the last column of the middle portions 236 of the contact elements 235 in the group. The first end baffle 403 may be positioned between the last column of the middle portions 236 of the contact elements 235 in the group and a first column of the middle portions 236 of the contact elements 235 in another adjacent group of the contact elements 235. The baffles 402 further include a second end baffle 404 which has a function similar to that of the first end baffle 403. The shields 400 including the baffles 402 can be made of any conductive material. Alternatively, the shields 400 and/or the baffles 402 can be polymeric and have a conductive layer or coating.

Referring to FIGS. 6 and 9, each shield 400 includes a first shield contact 405 for contacting each of the second connector contacts 255 of the second set 290 of the contact elements 235. Preferably, the first shield contact 405 is a slot in the shield 400 running generally transverse to the baffles 402 for receiving the second contacts or embossed sections 255 of the second set 290 of the contact elements 235. The shield 400 further includes a plurality of second shield contacts 415 positioned such that the second shield contacts 415 and the second connector contacts 255, excluding the second connector contacts 255 of the second set 290 of the contact elements 235 in the nth row, are arranged in rows and columns for connection to the circuit assembly 24. One of the second shield contacts 415 is shown in FIG. 6. It is within the scope of this invention for the second shield contacts 415 to be arranged in one or more rows and in such row(s) with or without the second connector contacts 255 (excluding the second connector contacts 255 of the second set 290 of the contact elements 235 in the nth row) positioned in the row(s) with the second shield contacts 415. Preferably, the second shield contacts 415 are end portions of pins. The second shield contacts 415 can have a different shape than the second connector contacts 255. For instance, both the second connector contacts 255 and the second shield contacts 415 can be pin shaped, but the cross section of one of them, such as the second shield contacts 415 can be larger than the cross section of the other. The second shield contacts 415 can be cast out of the same metal as the rest of the shield 400. Alternatively, the second shield contacts 415 can be end portions of conductive pins with a compliant or press-fit section 416 secured in holes or passages 417 in the shield 400.

Preferably, each shield 400 further comprises a first elongated outer side wall 410 connected to each of the baffles 402. The compliant or press-fit sections 416 of the pins with the second shield contacts 415 are received in passages 417 in the first side wall 410. Each shield 400 further comprises a second elongated outer side wall 412 connected to each of the baffles 402. The second embossed sections 255 (i.e., the second connector contacts 255 of the second set 290 of the contact elements 235 in the nth row) are received in the passages 405 in the second side wall 412. An outer surface of the second side wall 412 is generally perpendicular to an outer surface of the first side wall 410. A tab portion 411 of the first side wall 410 and/or a tab portion 413 of the second side wall 412 can extend past the end baffle 404 distal to end baffle 403 of the shield 400. The tab portions 411,413 are adapted to extend over a column of the contact elements 235 between a first end baffle 403 of a first one of the shields 400 and a second end baffle 404 of a second one of the shields 400. This is best seen in FIG. 5.

The first elongated outer side wall 410, the second elongated outer side wall 412 and adjacent pairs of the baffles 402 define pockets 408 for receiving the middle portions 236 of one column of the contact elements 235. To ensure that the middle portions 236 do not short out by contacting a conductive portion of the shield 400, the pockets 408 can be coated with an insulative layer, like layers 309 illustrated in FIG. 10.

Cleaning slots or passages 414 may exist through the shield 400 between the first side wall 410 and the second side wall 412 extending into each of the pockets 408. Further, the shields 400 may have stand-offs 416 along edges of the walls 410,412 and the baffles 402 to allow cleaning fluids to flow between the shield 400 and adjacent parts.

The angled or right angle receptacle 200 may further include an insulative spacer 450 associated with each one of the shields 400. The insulative spacers 450 may be the same as the insulative spacers 350. Holes 452 through the spacers 450 may be of different size or shape than the holes 352 in the spacer 350.

The first and second circuit assemblies 22, 24 can be any assemblies that include a plurality of conductors, leads, plated through holes or conductive paths, pads or areas 26. Each or either one of the circuit assemblies 22, 24 can be a printed wiring board or a printed circuit board, such as a backpanel, a mother board or a daughter board. Each or either one of the circuit assemblies 22, 24 can be a cable assembly. The circuit assemblies 22, 24 can be rigid or flexible.

It is further noted that the conductive U-shaped structures disclosed in U.S. Pat. No. 4,898,546 can be used in combination with the present invention to connect any of the contact elements 135, 235 to the shields 300, 400 and, thus, to ground, including any of the contact elements 135, 235 that are not in the nth row. Specifically, one or more of the U-shaped structures can be used as disclosed in U.S. Pat. No. 4,898,546. However, instead of securing the U-shaped structures in an insulative comb-like member, the U-shaped structures can be secured in the pockets 308 of the conductive shields 300, 400.

It will be recognized by those skilled in the art that the ground structures or shields of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetherimide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of the present invention as here-in-above set forth, can effect numerous modifications thereto. These modifications are to be construed as being encompassed within the scope of the present invention as set forth in the appended claims.

What is claimed is:

1. An angled or right angle electrical connector for electrically and mechanically interconnecting a circuit assembly and a second connector having a plurality of terminals, each terminal having a terminal contact, the terminal contacts arranged in rows and columns, the angled or right angle connector comprising:

an insulative housing;

a plurality of electrical contact elements in the housing wherein:

each one of the contact elements has a first connector contact and a second connector contact, the first connector contacts are arranged in rows and columns for contacting the terminal contacts, each one of the contact elements, except the contact elements with their first connector contacts in an nth row, includes a middle portion configured such that their second connector contacts extend at an angle with respect to the first connector contacts, a first set of the plurality of the contact elements with their first connector contacts in the nth row having a middle portion configured such that their second connector contacts extend at the angle with respect to the first connector contacts, and a second set of the plurality of the contact elements with their first connector contacts in the nth row; and a first conductive shield electrically connected to a subset of at least two of the second set, but none of the first set, of the contact elements.

2. An angled or right angle electrical connector for electrically and mechanically interconnecting a circuit assembly and a second connector having a plurality of terminals, each terminal having a terminal contact, the terminal contacts arranged in rows and columns, the angled or right angle connector comprising:

an insulative housing;

a plurality of electrical contact elements in the housing wherein:

each one of the contact elements has a first connector contact and a second connector contact, the first connector contacts are arranged in rows and columns for contacting the terminal contacts, each one of the contact elements, except the contact elements with their first connector contacts in an nth row, includes a middle portion configured such that their second connector contacts extend at an angle with respect to the first connector contacts, a first set of the contact elements with their first connector contacts in the nth row having a middle portion configured such that their second connector contacts extend at the angle with respect to the first connector contacts, and a second set of the contact elements with their first connector contacts in the nth row; and a plurality of conductive shields, each of the shields including:

baffles positioned between and spaced from columns of the middle portions of a group of the contact elements, a first shield contact for contacting each of the second connector contacts of the second set, but not the second connector contacts of the first set, in the group of the contact elements, and a plurality of second shield contacts positioned such that the second connector contacts, excluding the second connector contacts of the second set of contact elements in the nth row, and the second shield contacts are arranged in rows and columns for connection to the circuit assembly.

3. The angled or right angle electrical connector of claim 2, wherein the second connector contacts of the second set of the contact elements are collinear or parallel to the first connector contacts.

4. The angled or right angle electrical connector of claim 2, wherein one of the second set is between every pair of the first set.

5. The angled or right angle electrical connector of claim 2, further comprising:

a plurality of insulative spacers, each of the insulative spacers having a plurality of holes arranged in rows and columns; and each of the groups of the contact elements, except a first row of the contact elements and the second set, extending through the holes of a different one of the insulative spacers such that the second connector contacts, expect those of the second set, and the second shield contacts are on one side of the spacers and the middle portions are on another side of the spacers.

6. The angled or right angle electrical connector of claim 2, wherein the middle portions have a right angle bend.

7. The angled or right angle electrical connector of claim 2, wherein the first shield contacts are slots or holes in the shield.

8. The angled or right angle electrical connector of claim 2, wherein the first shield contacts comprise walls of a slot running generally transverse to the baffles.

9. The angled or right angle electrical connector of claim 2, wherein each of the shields further comprises:

a first elongated outer side wall connected to each of the baffles, the first outer side wall having an outer surface;

a second elongated outer side wall connected to each of the baffles, the second side wall having an outer surface generally perpendicular to the outer surface of the first side wall;

the first side wall, the second side wall and each adjacent pair of the baffles defining a pocket for receiving the middle portion of one column of the contact elements; and the first side wall and the second side wall defining cleaning passages into the pockets.

10. The angled or right angle electrical connector of claim 2, wherein the contact elements in the nth row are the longest contact elements.

11. The angled or right angle electrical connector of claim 2, wherein:

the terminal contacts comprise end portions of pins;

the first connector contacts comprise sockets;

the second connector contacts comprise solder tails; and the second shield contacts are end portions of pins 12. The angled or right angle electrical connector of claim 2, wherein:

the terminal contacts comprise sockets;

the first connector contacts comprise pin end portions;

the second connector contacts comprise pin end portions; and the second shield contacts are pin end portions.

13. An angled or right angle electrical receptacle for electrically and mechanically interconnecting a circuit assembly and a plurality of terminals with a plurality of terminal contacts arranged in rows and columns in a header or shroud, the receptacle comprising:

an insulative housing having a first, header or shroud, mating surface and a plurality of passages arranged in rows and columns extending perpendicularly from the first mating surface through the housing;

a plurality of electrical contact elements, each one of the contact elements having a first connector contact and a second connector contact, one of the first connector contacts positioned in each one of the passages for contacting one of the terminal contacts, each one of the contact elements, except the contact elements with their first connector contacts in an nth row of the passages, having a middle portion configured such that their second connector contacts extend at an angle with respect to the first connector contacts, a first set of a plurality of the contact elements with their first connector contacts in the nth row of the passages having a middle portion configured such that their second connector contacts extend at the angle with respect to the first connector contacts, and a second set of a plurality of the contact elements with their first connector contacts in the nth row; and a first conductive shield electrically connected to a subset of at least two of the second set, but none of the first set, of the contact elements.

14. An angled or right angle electrical receptacle for electrically and mechanically interconnecting a circuit assembly and a plurality of terminals with a plurality of terminal contacts arranged in rows and columns in a header or shroud, the receptacle comprising:

an insulative housing having a first, header or shroud, mating surface and a plurality of passages arranged in rows and columns extending perpendicularly from the first mating surface through the housing;

a plurality of electrical contact elements, each one of the contact elements having a first connector contact and a second connector contact, one of the first connector contacts positioned in each one of the passages for contacting one of the terminal contacts, each one of the contact elements, except the contact elements with their first connector contacts in an nth row of the passages, having a middle portion configured such that their second connector contacts extend at an angle with respect to the first connector contacts, a first set of the contact elements with their first connector contacts in the nth row the passages having a middle portion configured such that their second connector contacts extend at the angle with respect to the first connector contacts, and a second set of the contact elements with their first connector contacts in the nth row; and a plurality or conductive shields, each of the shields including:

baffles positioned between and spaced from columns of the middle portions of a group of the contact elements, a first shield contact for contacting each of the second connector contacts of the second set, but not the second connector contacts of the first set, in the group of contact elements, and a plurality of second shield contacts positioned such that the second shield contacts and the second connector contacts, excluding the second connector contacts of the second set of contact elements in the nth row, are arranged in rows and columns for connection to the circuit assembly.

15. An angled or right angle electrical header for electrically and mechanically interconnecting a circuit assembly and a plurality of terminals with a plurality of terminal contacts arranged in rows and columns in a receptacle, the header comprising:

an insulative housing having a base and side walls, the base and the side walls partially enclosing a contact region, the base having a plurality of passages arranged in rows and columns extending through the base;

a plurality of electrical contact elements;

each one of the contact elements having a first connector contact and a second connector contact, one of the contact elements fixed in each of the passages with the fist connector contacts positioned in the contact region for contacting one of the terminal contacts, each one of the contact elements except the contact elements in an nth row of the passages, having a middle portion configured such that their second connector contacts extend at an angle with respect to the first connector contacts, a first set of a plurality of the contact elements in the nth row of the passages having a middle portion configured such that their second connector contacts extend at the angle with respect to the first connector contacts, and a second set of a plurality of the contact elements in the nth row of the passages; and a first conductive shield electrically connected to a subset of at least two of the second set, but none of the first set, of the contact elements.

16. An angled or right angle electrical header for electrically and mechanically interconnecting a circuit assembly and a plurality of terminals with a plurality of terminal contacts arranged in rows and columns in a receptacle, the header comprising:

an insulative housing having a base and side walls, the base and the side walls partially enclosing a contact region, the base having a plurality of passages arranged in rows and columns extending through the base;

a plurality of electrical contact elements, each one of the contact elements having a first connector contact and a second connector contact, one of the contact elements fixed in each of the passages with the first connector contact positioned in the contact region for contacting one of the terminal contacts, each one of the contact elements, except the contact elements in an nth row of the passages, having a middle portion configured such that their second connector contacts extend at an angle with respect to the first connector contacts, a first set of the contact elements in the nth row of the passages having a middle portion configured such that their second connector contacts extend at the angle with respect to the first connector contacts, and a second set of the contact elements in the nth row of the passages; and a plurality of conductive shields, each of the shields including:

baffles positioned between and spaced from columns of the middle portions of a group of the contact elements, a first shield contact for contacting each of the second connector contacts of the second set, but not the second connector contacts of the first set, in the group of contact elements, and a plurality of second shield contacts positioned such that the second shield contacts and the second connector contacts, excluding the second connector contacts of the second set of contact elements in the nth row, are arranged in rows and columns for connection to the circuit assembly.

17. A conductive shield for reducing cross talk between contact elements in angled or right angle connectors having an insulative housing and a plurality of the contact elements mounted in the housing, each one of the contact elements having a first connector contact and a second connector contact, the first connector contacts arranged in rows and columns, the shield comprising:

a plurality of baffles, each of the baffles for positioning between adjacent columns of middle portions of the contact elements such that the baffles are spaced from the contact elements, a plurality of first shield contacts, one of the first shield contacts for contacting each of the second connector contacts of a subset of a first set, but none of a second set, of the contact elements in an nth row of the contact elements, and a plurality of second shield contacts positioned such that the second connector contacts of the contact elements, excluding the second connector contacts of the first set of the contact elements in the nth row, and the second shield contacts are for being arranged in rows and columns that are at an angle with respect to the rows and columns of the first connector contacts of the contact elements.

18. The shield of claim 17, wherein the first shield contacts are slots or holes in the shield.

19. The shield of claim 17, wherein the first shield contacts comprise walls of a slot running generally transverse to the baffles.

20. The shield of claim 17, wherein the shield further comprises:

a first elongated outer side wall connected to each of the baffles, the first outer side wall having an outer surface;

a second elongated outer side wall connected to each of the baffles, the second side wall having an outer surface generally perpendicular to the outer surface of the first side wall;

the first side wall, the second side wall, and each adjacent pair of the baffles defining a pocket for receiving the middle portion of one column of the contact elements; and the first side wall and the second side wall defining cleaning passages into the pockets.

21. The shield of claim 17, wherein the baffles are coated with an insulative layer.

22. An angled or right angle electrical connector for electrically and mechanically interconnecting a circuit assembly and a second connector having a plurality of terminals, each terminal having a terminal contact, the terminal contacts arranged in rows and columns, the angled or right angle connector comprising:

an insulative housing;

a plurality of electrical contact elements in the housing wherein:

each one of the contact elements has a first connector contact and a second connector contact, the first connector contacts are arranged in rows and columns for contacting the terminal contacts, each one of the contact elements, except the contact elements with their first connector contacts in an nth row, includes a middle portion configured such that their second connector contacts extend at an angle with respect to the first connector contacts, a first set of the plurality of the contact elements with their first connector contact in the nth row having a middle portion configured such that their second connector contacts extend at the angle with respect to the first connector contacts, and a second set of the plurality of the contact elements with their first connector contacts in the nth row, the second set being different in shape than the first set; and a first conductive shield electrically connected to a subset of the second set, but none of the first set, of the contact elements.

23. An angled or right angle electrical receptacle for electrically and mechanically interconnecting a circuit assembly and a plurality of terminals with a plurality of terminal contacts arranged in rows and columns in a header or shroud, the receptacle comprising:

an insulative housing having a first, header or shroud, mating surface and a plurality of passages arranged in rows and columns extending perpendicularly from the first mating surface through the housing;

a plurality of electrical contact elements, each one of the contact elements having a first connector contact and a second connector contact, one of the first connector contacts positioned in each one of the passages for contacting one of the terminal contacts, each one of the contact elements, except the contact elements with their first connector contacts in an nth row of the passages, having a middle portion configured such that their second connector contacts extend at an angle with respect to the first connector contacts, a first set of a plurality of the contact elements with their first connector contacts in the nth row of the passages having a middle portion configured such that their second connector contacts extend at the angle with respect to the first connector contacts, and a second set of a plurality of the contact elements with their first connector contacts in the nth row, the second set being different in shape than the first set; and a first conductive shield electrically connected to a subset of the second set, but none of the first set, of the contact elements.

24. An angled or right angle electrical header for electrically and mechanically interconnecting a circuit assembly and a plurality of terminals with a plurality of terminal contacts arranged in rows and columns in a receptacle, the header comprising:

an insulative housing having a base and side walls, the base and the side walls partially enclosing a contact region, the base having a plurality of passages arranged in rows and columns extending through the base;

a plurality of electrical contact elements, each one of the contact elements having a first connector contact and a second connector contact, one of the contact elements fixed in each of the passages with the first connector contacts positioned in the contact regions for contacting one of the terminal contacts, each one of the contact elements, except the contact elements in an nth row of the passages, having a middle portion configured such that their second connector contacts extend at an angle with respect to the first connector contacts, a first set of a plurality of the contact elements in the nth row of the passages having a middle portion configured such that their second connector contacts extend at the angle with respect to the first connector contacts, and a second set of a plurality of the contact elements in the nth row of the passages, the second set being different in shape than the first set; and a first conductive shield electrically connected to a subset of the second set, but none of the first set, of the contact elements.

* * * * *